US008347631B2

(12) United States Patent
Bailey et al.

(10) Patent No.: US 8,347,631 B2
(45) Date of Patent: Jan. 8, 2013

(54) FUEL NOZZLE LIQUID CARTRIDGE INCLUDING A FUEL INSERT

(75) Inventors: Donald Mark Bailey, Simpsonville, SC (US); Scott R Simmons, Simpsonville, SC (US); Gregory Allen Boardman, Greer, SC (US); Xiomara Irizarry-Rosado, Greer, SC (US)

(73) Assignee: General Electric Company, Schenectady, NY (US)

( * ) Notice: Subject to any disclaimer, the term of this patent is extended or adjusted under 35 U.S.C. 154(b) by 980 days.

(21) Appl. No.: 12/397,240

(22) Filed: Mar. 3, 2009

(65) Prior Publication Data

US 2010/0223929 A1 Sep. 9, 2010

(51) Int. Cl.
*F02C 1/00* (2006.01)
*F02G 3/00* (2006.01)

(52) U.S. Cl. ..... 60/740; 60/742; 60/39.55; 239/422

(58) Field of Classification Search ..... 60/39.55, 60/737, 746, 747, 748, 740, 742, 804, 734; 239/422, 424, 424.5
See application file for complete search history.

(56) References Cited

U.S. PATENT DOCUMENTS 4,519,769 A * 5/1985 Tanaka ..... 431/4
4,890,453 A * 1/1990 Iwai et al. ..... 60/39.465
4,938,019 A 7/1990 Angell et al.
5,224,333 A * 7/1993 Bretz et al. ..... 60/740
5,228,283 A 7/1993 Sciocchetti
5,259,184 A * 11/1993 Borkowicz et al. ..... 60/39.55
5,355,670 A 10/1994 Sciocchetti
5,415,000 A * 5/1995 Mumford et al. ..... 60/747
5,505,045 A * 4/1996 Lee et al. ..... 60/748
5,697,553 A * 12/1997 Stotts ..... 239/8
5,713,205 A * 2/1998 Sciocchetti et al. ..... 60/740
5,722,230 A * 3/1998 Cohen et al. ..... 60/39.37
5,729,968 A * 3/1998 Cohen et al. ..... 60/39.6
5,784,875 A * 7/1998 Statler ..... 60/775
5,833,141 A 11/1998 Bechtel, II et al.
5,924,275 A * 7/1999 Cohen et al. ..... 60/778
6,397,602 B2 * 6/2002 Vandervort et al. ..... 60/737
6,655,145 B2 12/2003 Boardman
7,000,403 B2 2/2006 Henriquez et al.
7,104,070 B2 9/2006 Iasillo et al.
7,165,405 B2 * 1/2007 Stuttaford et al. ..... 60/737
7,185,494 B2 * 3/2007 Ziminsky et al. ..... 60/746
7,406,827 B2 * 8/2008 Bernero et al. ..... 60/742
7,412,833 B2 * 8/2008 Widener ..... 60/772
7,546,735 B2 * 6/2009 Widener ..... 60/746
7,661,269 B2 * 2/2010 Bonzani et al. ..... 60/748
7,757,491 B2 * 7/2010 Hessler ..... 60/746
8,057,220 B2 * 11/2011 Bretz ..... 431/159
2008/0155987 A1 * 7/2008 Amond et al. ..... 60/737
2009/0223225 A1 * 9/2009 Kraemer et al. ..... 60/723
2010/0024425 A1 * 2/2010 Cihlar et al. ..... 60/734
2010/0242490 A1 * 9/2010 Symonds ..... 60/775
2010/0294858 A1 * 11/2010 Steinhaus et al. ..... 239/418
2011/0083441 A1 * 4/2011 Khosla et al. ..... 60/746

* cited by examiner

*Primary Examiner* — William H Rodriguez
(74) *Attorney, Agent, or Firm* — Fletcher Yoder, P.C.

(57) ABSTRACT

In an embodiment, a system includes an end cover and a liquid cartridge. The liquid cartridge is configured to mount in a fuel nozzle of a turbine engine, wherein the liquid cartridge comprises a one piece flange configured to couple to the end cover, wherein the flange comprises a water inlet, an air inlet, and a fuel inlet.

21 Claims, 6 Drawing Sheets

FUEL NOZZLE LIQUID CARTRIDGE INCLUDING A FUEL INSERT

BACKGROUND OF THE INVENTION

The present disclosure relates generally to a turbine engine and, more specifically, to a fuel nozzle with an improved liquid cartridge.

Mixing liquid fuel and air affects engine performance and emissions in a variety of engines, such as turbine engines. For example, a turbine engine may employ one or more fuel nozzles to facilitate fuel-air mixing in a combustor. Each fuel nozzle may include a liquid cartridge to enable distribution and mixing of the liquid fuel and air in the combustor. The liquid cartridge may include a tip portion, a central body, and a flange configured to couple to fuel, air, and water supplies. Unfortunately, the configuration of the tip and its component may cause flow disruption and wear that may require replacement and/or maintenance of the liquid cartridge. Further, the configuration of the central body requires support in the chambers of the body as fluid flows through it. The central body can require a special alignment with respect to the tip, due to supports within the central body as well, increasing complexity of the liquid cartridge. In addition, the flange may have a plurality of components that lead to increased complexity and cost. As a result, the liquid cartridge may have increased costs due to complexity of the assembly and maintenance due unwanted wear and tear.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a liquid cartridge configured to mount in a fuel nozzle of a turbine engine, wherein the liquid cartridge includes an atomizing air tip, a water tip disposed coaxially within the atomizing air tip, and a fuel tip disposed coaxially within the water tip. The liquid cartridge also includes a shroud disposed coaxially between the atomizing air tip and the water tip, wherein the shroud is fixedly secured to the atomizing air tip and a fuel insert disposed coaxially within the fuel tip, wherein the fuel insert comprises an upstream end portion that radially expands in a downstream axial direction of flow through the liquid cartridge.

In a second embodiment, a system includes a liquid cartridge configured to mount in a fuel nozzle of a turbine engine. The liquid cartridge includes a standoff radially separating coaxial tubes of the liquid cartridge, wherein the standoff defines a plurality of equal sized channels between the coaxial tubes, and the standoff is symmetrical about a central axis of the liquid cartridge.

In a third embodiment, a system includes an end cover and a liquid cartridge. The liquid cartridge is configured to mount in a fuel nozzle of a turbine engine, wherein the liquid cartridge comprises a one piece flange configured to couple to the end cover, wherein the flange comprises a water inlet, an air inlet, and a fuel inlet.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
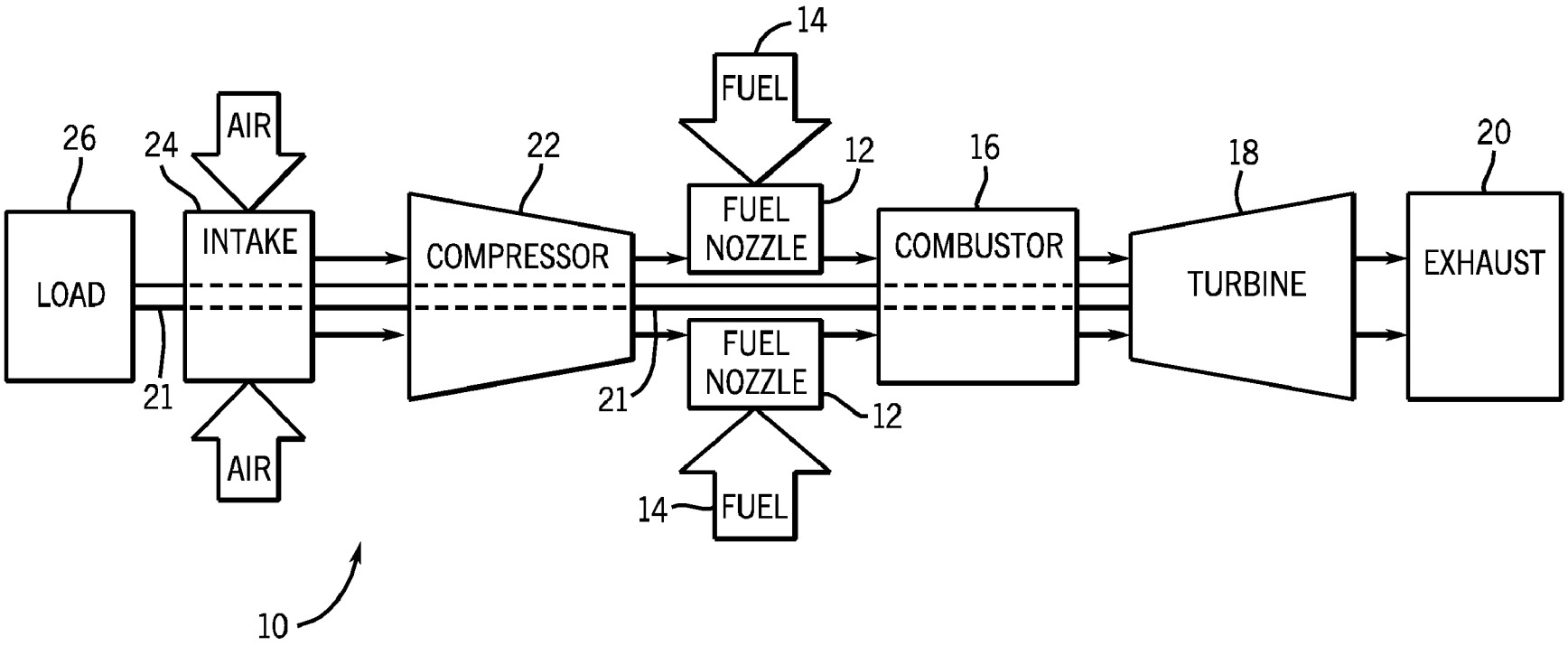
FIG. 1 is a block diagram of a turbine system having fuel nozzles with an improved liquid cartridge in accordance with certain embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, various embodiments of liquid cartridges for turbine fuel nozzles may be employed to improve the performance of a turbine engine. The liquid cartridges may be placed inside a turbine fuel nozzle and may be coupled to an end cover of a combustor to enable use of liquid fuel within a turbine system. For example, embodiments of the liquid cartridges may include an improved tip portion, wherein a shroud is fixedly secured to an atomizing air tip to reduce backflow and wear. Further, the tip portion includes a fuel tip insert configured to improve fuel flow through the fuel tip. Specifically, the fuel tip insert expands radially in a downstream direction, thereby enabling a smooth flow of fuel through the liquid cartridge. In an embodiment, the liquid cartridge includes standoffs or spacers in a central body configured to increase rigidity of the liquid cartridge and reduce complexity of the liquid cartridge. For example, the standoffs may have a square shaped cross section that is symmetrical about an axis of the central body. The standoffs create four equal sized channels that enable flow of water and/or air to the liquid cartridge tip portion. Further, the standoffs enable the central body to be connected to the tip portion without regard to the rotational orientation of the standoffs, simplifying the manufacturing of the liquid cartridge. In certain embodiments, the liquid cartridge includes a flange that is a single piece that includes an air inlet, water inlet, and fuel inlet. The single piece flange may be made of a cast alloy, simplifying the manufacturing process and reducing the cost of separate components. Further, the single piece flange improves durability by reducing components within the flange. The disclosed embodiments increase performance and durability while decreasing complexity and manufacturing costs for the liquid cartridge.

FIG. 1 is a block diagram of an embodiment of a turbine system 10 in accordance with certain embodiments of the present technique. As discussed in detail below, the disclosed embodiments employ a fuel nozzle 12 with an improved liquid cartridge designed to increase performance and durability of the turbine system 10. Turbine system 10 may use liquid and/or gas fuel, such as natural gas and/or a petroleum-based liquid fuel, such as Naphtha, Petroleum Distillate or a Bio-Fuel, to run the turbine system 10. As depicted, the fuel nozzles 12 intake a fuel supply 14, mix the fuel with air, and distribute the air-fuel mixture into a combustor 16. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 21 along an axis of system 10. As illustrated, the shaft 21 is connected to various components of turbine system 10, including a compressor 22. Compressor 22 also includes blades coupled to the shaft 21. Thus, blades within the compressor 22 rotate as the shaft 21 rotates, thereby compressing air from air intake 24 through compressor 22 into fuel nozzles 12 and/or combustor 16. The shaft 21 is also connected to a load 26, which may be a vehicle or a stationary load, such as an electrical generator in a power plant or a propeller on an aircraft. Load 26 may be any suitable device that is powered by the rotational output of turbine system 10. As described in detail below, the fuel nozzle 12 may include a liquid cartridge configured to enable use of liquid fuel to power the turbine system 10. Further, the liquid cartridge includes improvements to the tip portion, standoffs in a central body, and a flange that reduce complexity, improve performance, reduce costs, and simplify manufacturing.

Figure 2:
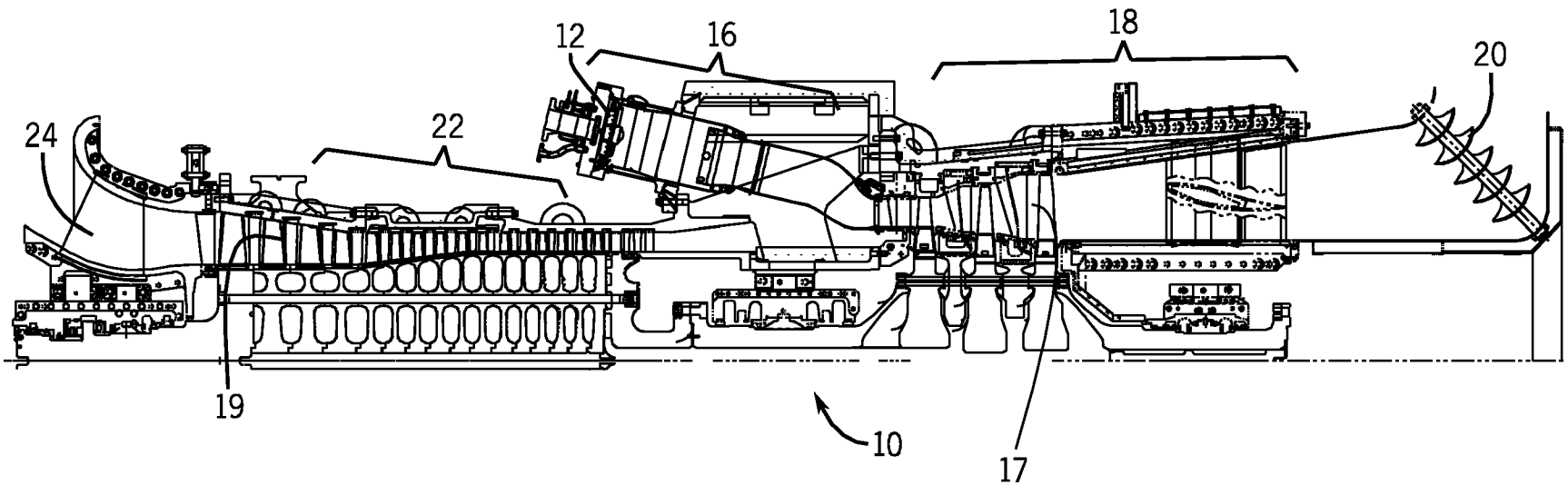
FIG. 2 is a cutaway side view of the turbine system, as shown in FIG. 1, in accordance with certain embodiments of the present technique.

FIG. 2 is a cutaway side view of an embodiment of the turbine system 10. The turbine system 10 includes one or more fuel nozzles 12 located inside one or more combustors 16 in accordance with unique aspects of the disclosed embodiments. In one embodiment, six or more fuel nozzles 12 may be attached to the base of each combustor 16 in an annular or other arrangement. Moreover, the turbine system 10 may include a plurality of combustors 16 (e.g., 4, 6, 8, 12) in an annular arrangement. Air enters the turbine system 10 through the air intake 24 and may be pressurized in the compressor 22. The compressed air may then be mixed with fuel by the fuel nozzles 12 for combustion within the combustor 16. For example, the fuel nozzles 12 may inject a fuel-air mixture into combustors in a suitable ratio for optimal combustion, emissions, fuel consumption, and power output. The combustion generates hot pressurized exhaust gases, which then drive blades within the the turbine 18 to rotate the shaft 21 and, thus, the compressor 22 and load 26. As depicted, the rotation of turbine blades 17 cause a rotation of the shaft 21, thereby causing blades 19 within the compressor 22 to draw in and pressurize air. Thus, proper mixture and placement of the air and fuel stream by fuel nozzles 12 is important to improving the emissions performance of the turbine system 10. As described below, the fuel nozzle 12 includes a liquid cartridge that includes improvements to the tip portion, standoffs in a central body, and a flange that reduce complexity, improve performance, reduce costs, and simplify manufacturing. For example, the liquid cartridge may include standoffs in a central body configured to increase rigidity of the liquid cartridge and reduce complexity of the liquid cartridge. The standoff may be symmetrical about an axis of the central body and may include a plurality of equal sized channels for flow of air and/or water in a downstream direction. Specifically, the standoffs increase support of the liquid cartridge and are orientation independent with respect to other components of the liquid cartridge, reducing manufacturing complexity and costs.

Figure 3:
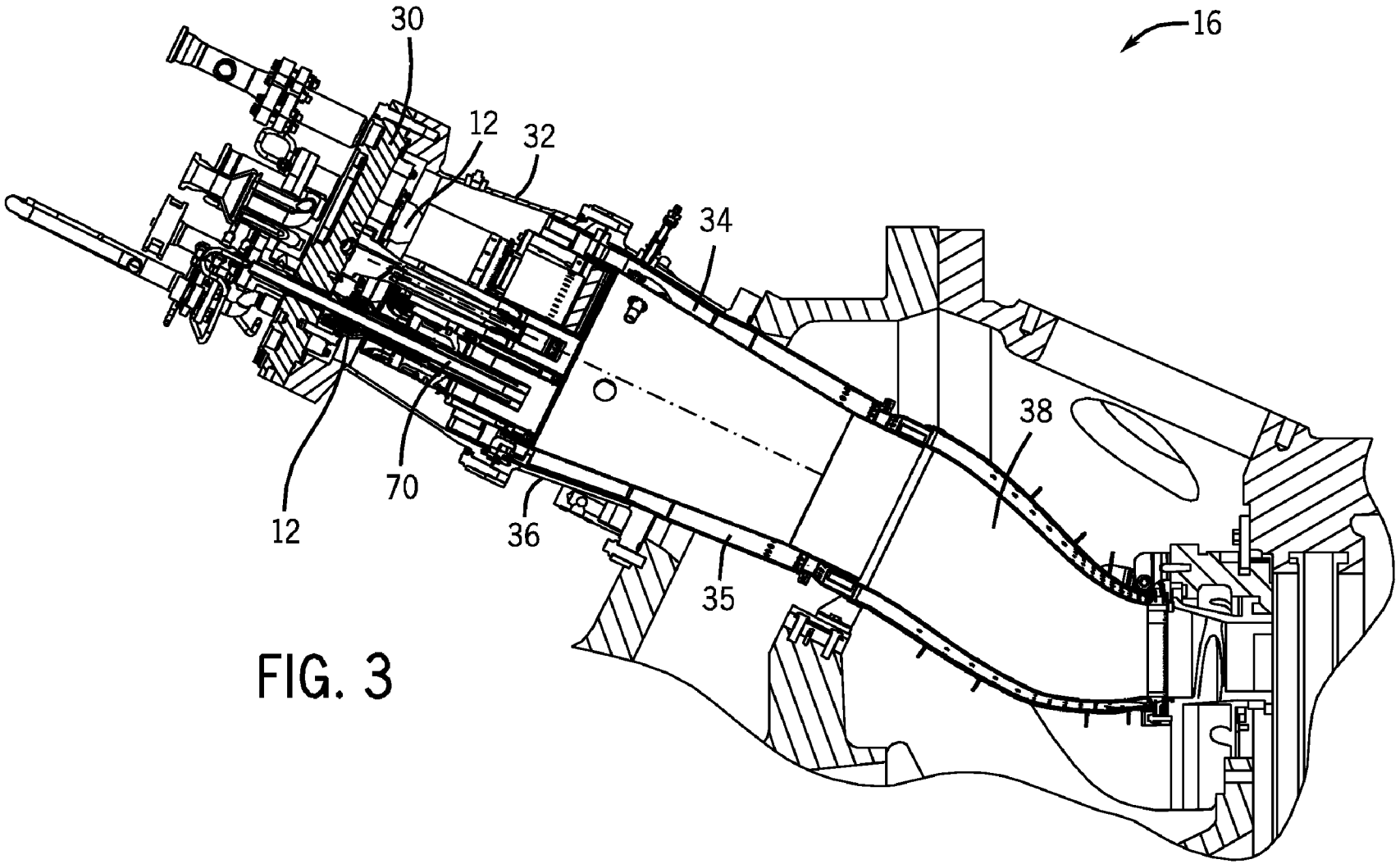
FIG. 3 is a cutaway side view of the combustor, as shown in FIG. 1, with a plurality of liquid cartridges coupled to an end cover of the combustor in accordance with certain embodiments of the present technique.

A detailed view of an embodiment of combustor 16, as shown FIG. 2, is illustrated in FIG. 3. In the diagram, a plurality of fuel nozzles 12 are attached to end cover 30, near the base of combustor 16. In an embodiment, six fuel nozzles 12 are attached to end cover 30. Compressed air and fuel are directed through end cover 30 to each of the fuel nozzles 12, which distribute an air-fuel mixture into combustor 16. Combustor 16 includes a chamber generally defined by casing 32, liner 34, and flow sleeve 36. In certain embodiments, flow sleeve 36 and liner 34 are coaxial with one another to define a hollow annular space 35. Air from compressor 22 may enter the hollow annular space 35 through perforations in the flow sleeve 36, and then flow upstream toward end cover 30 and fuel nozzles 12 to provide cooling of the liner 34 prior to the entry into the combustion zone via the fuel nozzles 12. The design of casing 32, liner 34, and flow sleeve 36 provide optimal flow of the air fuel mixture in the downstream direction through transition piece 38 (e.g., converging section) towards turbine 18. For example, fuel nozzles 12 may distribute a pressurized air fuel mixture into combustor 16 through liner 34, wherein combustion of the mixture occurs. The resultant exhaust gas flows through transition piece 38 to turbine 18, causing blades of turbine 18 to rotate, along with shaft 21. In an ideal combustion process, the air-fuel mixture combusts downstream of the fuel nozzles 12, within combustor 16. The fuel nozzles 12 also each include a liquid cartridge 70. The liquid cartridge 70 may be located within the fuel nozzle 12 and may include an improved design for tip portion components. Additionally, the liquid cartridge 70 includes standoffs in the central body designed to improve rigidity and reduce complexity during production of the combustor. The liquid cartridge 70 also includes a simplified flange composed of one piece, configured to couple the liquid cartridge 70 to the end cover 30.

Figure 4:
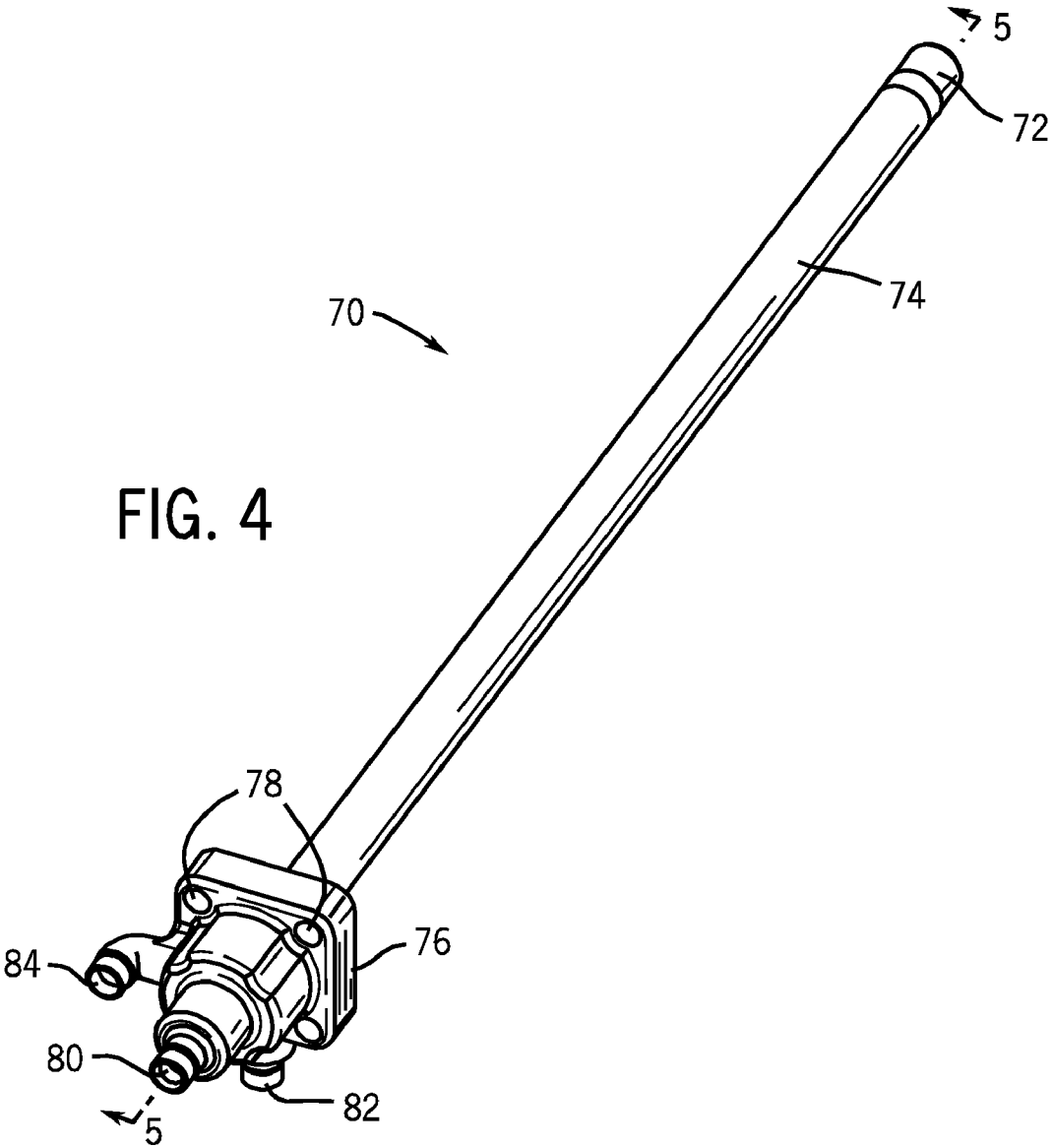
FIG. 4 is a perspective view of the liquid cartridge, as shown in FIG. 3, in accordance with certain embodiments of the present technique.

FIG. 4 is a perspective view of an embodiment of the liquid cartridge 70 including improvements that enable improved durability and reduced costs. As depicted, the liquid cartridge 70 includes a tip portion 72 that includes several components and materials designed to reduce downtime and improve performance of the liquid cartridge 70. As described in detail below, the improved tip portion 72 may include Cobalt-based alloy, such as a Cobalt-chromium alloy or Cobalt alloy L605, components that may be resistant to excessive wear, excessive heating, and other maintenance issues. Further, the improved tip portion 72 may also be designed to prevent unwanted air flow and improve fuel flow through the tip portion 72, thereby improving the performance liquid cartridge 70. The liquid cartridge 70 also includes central body 74, which may enable flow of water, air, and fuel to the turbine combustor. In an embodiment, the central body 74 may include support within the body and its cavities to improve structural rigidity and resist deformation. As discussed in detail below, the central body 74 may include standoffs designed to support the central body 74, thereby improving its structural rigidity. The liquid cartridge 70 also includes a flange 76, which may be bolted to the combustor end cover 30 through holes 78. In addition, the flange 76 has inlets for various fluids, including a fuel inlet 80, an air inlet 82, and a water inlet 84. The design of the flange 76 is such that it may be formed in one piece, such as by casting, of steel or metal alloy or other durable material. The one piece structure of the flange 76 enables reduced complexity in the flange 76 by reducing the number of components that comprise the flange, thereby reducing manufacturing costs, wear and tear, and manufacturing complexity. In another embodiment, the flange 76 and liquid cartridge 70 may be cast as a single piece, further reducing complexity and costs. In addition, the design of standoffs in central body 74 and components of the tip portion 72 may improve performance and durability for the liquid cartridge 70.

Figure 5:
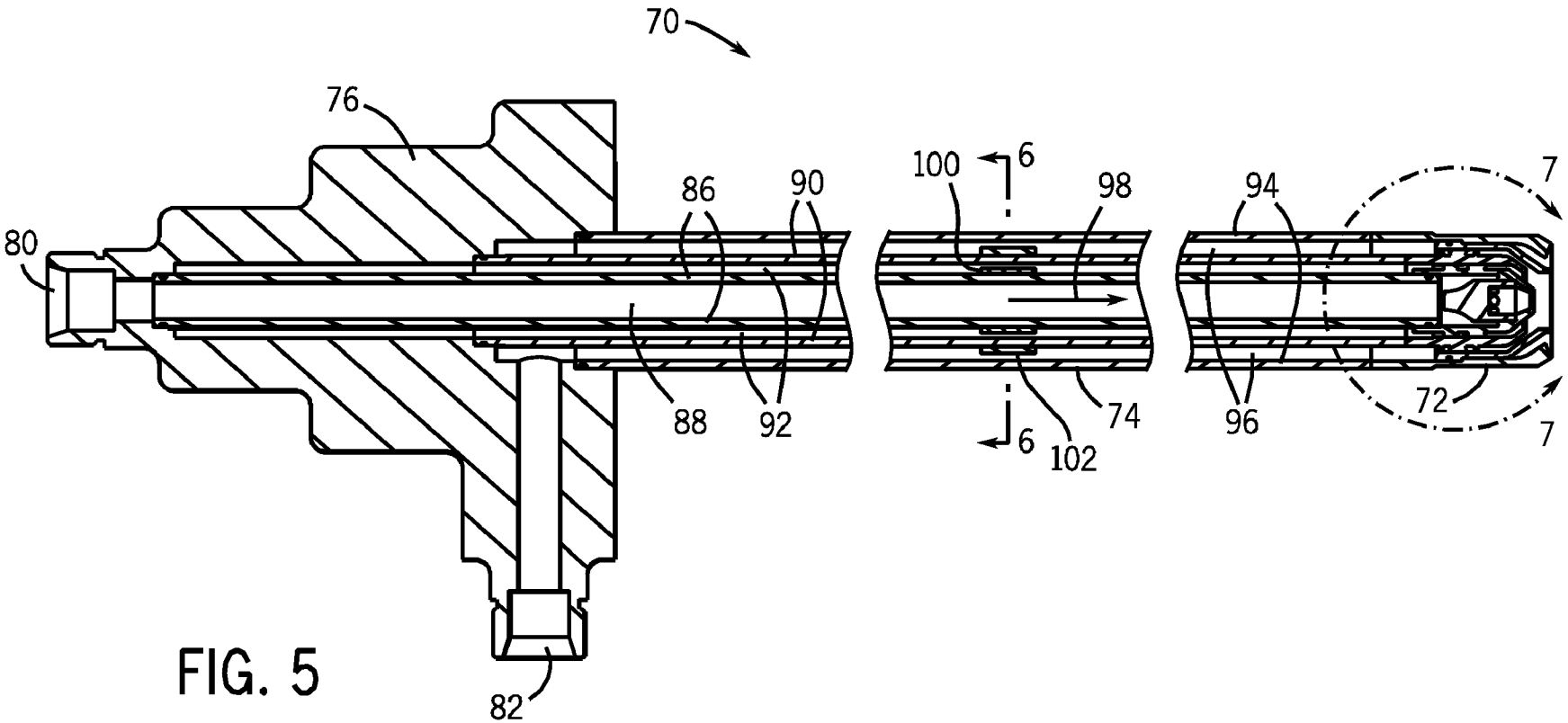
FIG. 5 is a sectional side view of the liquid cartridge, as shown in FIG. 4, in accordance with certain embodiments of the present technique.

FIG. 5 is a sectional side view of an embodiment of the liquid cartridge 70. The detailed sectional view of the liquid cartridge 70 illustrates the cavities and structures within the liquid cartridge 70. A central fuel tube 86 may be located within the liquid cartridge 70, thereby enabling fluid communication of fuel from the fuel inlet 80 to the tip portion 72. For example, the fuel inlet 80 may be coupled, via hoses or tubes, to a liquid fuel supply, such as a fuel tank. Further, the coupling of the fuel hose to the fuel inlet 80 may occur by any suitable mechanism, including threaded couplings, welding, brazing, or other appropriate leak-proof coupling. The flow of liquid fuel from the fuel inlet 80 through a fuel cavity 88 within the fuel tube 86 supplies the combustor with fuel to be mixed with air and water for combustion, thereby driving the turbine blades.

Similarly, a water tube 90 may be located outside of, and concentric to, the fuel tube 86. In addition, a water cavity 92, located between the water tube 90 and the fuel tube 86 enables fluid communication of water from the water inlet 84 to the tip portion 72. Further, the water is injected from the tip portion 72 into the combustion zone to add mass to the combustion fluids resulting in an increase in overall combustion turbine power. As discussed in detail below, the water cavity 92 may have standoffs 100 located in the center of the central body 74, between the walls of the fuel tube 86 and water tube 90, to improve the structural rigidity of the liquid cartridge 70.

In addition, an air tube 94 may be located outside of, and concentric to, the water tube 90. An air cavity 96 may be located between the air tube 94 and water tube 90, thereby enabling fluid communication of air from the air inlet 82 to the tip portion 72 for injection into the combustion zone. Further, the air cavity 96 may have standoffs 102 or other structural supports, centrally located within the central body 74, configured to provide structural rigidity and re-enforcement between the walls of the air tube 94 and the water tube 90.

As depicted, the air, water, and fuel may flow in a downstream direction 98 toward the tip portion 72 for injection through the fuel nozzle 12 into the turbine's combustor 16, thereby enabling combustion to drive the turbine engine 10. As illustrated, the air, water, and fuel flows are generally coaxial or concentric with one another due to the coaxial or concentric arrangement of tubes 86, 90, and 94. Likewise, standoffs 100 and 102 are coaxial or concentric with one another at the same axial position or at different axial positions. The standoffs 100 and 102 improve rigidity in the liquid cartridge 70 and also reduce resonance and/or bending of the cartridge in response to forces. Specifically, the stand offs 100 and 102 increase the tube assembly (86, 90, and 94) stiffness and change the frequency response of the liquid cartridge 70 assembly. In one embodiment, the standoffs 100 and 102 shift the liquid cartridge resonant frequencies away from the principle machine rotor driving frequencies. Accordingly, the standoffs 100 and 102 increase durability and performance of the liquid cartridge 70. The standoffs 100 and 102 may also be referred to as spacers, wherein the standoffs or spacers provide structural support for the liquid cartridge 70 while enabling fluid passage through chambers of the cartridge. In an embodiment, the inner standoff 100 and outer standoff 102 are located at the same axial position near the middle of the central body 74, to improve support within the cavities of the liquid cartridge 70. In other embodiments, the standoffs 100 and 102 may be located at multiple axial locations, wherein the axial location of standoffs 100 and 102 are either the same or different. For example, the liquid cartridge 70 may include 1, 2, 3, 4, 5, 6, 7, 8, 9, or 10 standoffs 100 and 102 spaced at equally spaced axial positions. The number, size and locations of the standoffs may depend on the length of the liquid cartridge 70 and the standoffs themselves, as well as operating conditions. As depicted, the liquid cartridge 70 may be a relatively shorter length than other cartridges, and therefore may only include one standoff 100 and one standoff 102. The standoffs 100 and 102 may be aligned, as depicted, or oriented differently within the tubes 94 and 90. Further, the design of the central body 74 enables improved rigidity for the liquid cartridge 70, thereby improving durability and performance.

Figure 6:
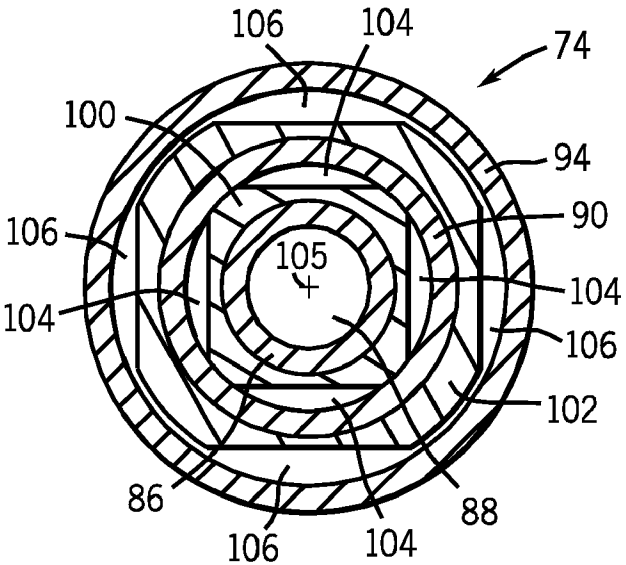
FIG. 6 is a sectional end view of the liquid cartridge, as shown in FIG. 4, in accordance with certain embodiments of the present technique.

FIG. 6 is a sectional end view of the central body 74. The inner standoff 100 is located between the fuel tube 86 and the water tube 90. As depicted, the inner standoff 100 is square shaped and symmetrical about a central axis or center point 105 of the central body 74. The outer standoff 102 is located between the air tube 94 and water tube 90. The outer standoff 102 is also square shaped and symmetrical about the center point 105. As depicted, the inner standoff 100 enables a flow of water through cavities or channels 104. In an example, the channels 104 are all of equal size and are also symmetrical about the center point 105 of the illustrated cross section. In addition, outer channels 106 enable flow of air toward the tip portion 72 of the liquid cartridge 70. Further, the cavities or channels 106 are of equal size and are symmetrical about the center point 105 of the central body 74 cross section. As depicted, the inner standoff 100 and outer standoff 102 may be aligned, wherein the sides of each of the standoff's squares are parallel.

In some embodiments, the inner standoff 100 and outer standoff 102 may be of different shapes, including a simple polygon, triangle, a pentagon, a hexagon, or other geometric shape configured to support the cavities within central body 74. Standoffs 100 and 102 may have the same or different shapes, e.g., square and triangle, square and pentagon, square and hexagon, pentagon and triangle, pentagon and hexagon, and so forth. Further, the inner standoff 100 and outer standoff 102 may not be aligned in other embodiments.

The symmetrical configuration of the inner standoff 100 and outer standoff 102 enable the central body 74 to be orientation independent of adjacent liquid cartridge 70 components, including the tip portion 72. The central body 74 may be orientation independent with respect to its rotational orientation about central axis or center point 105. Specifically, the inner standoff 100 and outer standoff 102 enable the central body 74 to be connected to the tip portion 72 at any rotational orientation without regard to the alignment of the standoffs in relation to the flow and cavities within the liquid cartridge 70. Because of the orientation independent standoffs, the symmetry of the flow cavities created by standoffs 100 and 102 enable a user to assemble the liquid cartridge to adjacent components, such as the tip 72 and flange 76, without regard to the rotational orientation of the liquid cartridge 70. In particular, due to their symmetry, a flow field through the tubes is not impacted by the position of the standoffs 100 and 102. In non-symmetrical embodiments, including one slot or multiple stand offs aligned with one slot, the fluid could create a flow direction that needs to be oriented to the exit flow swirl of the tip. Symmetric standoffs 100 and 102 lead to no flow rotation and thus no impact to flow at exit. In some embodiments, the standoffs 100 and/or 102 may define a non-symmetrical arrangement of flow passages about the center point 105. In such embodiments, the central body 74 may not be orientation independent of adjacent liquid cartridge components. For example, the standoffs 100 and 102 may be C-shaped with a single channel for flow, thereby requiring alignment with respect to the tip portion 72, further complicating assembly and manufacturing.

Figure 7:
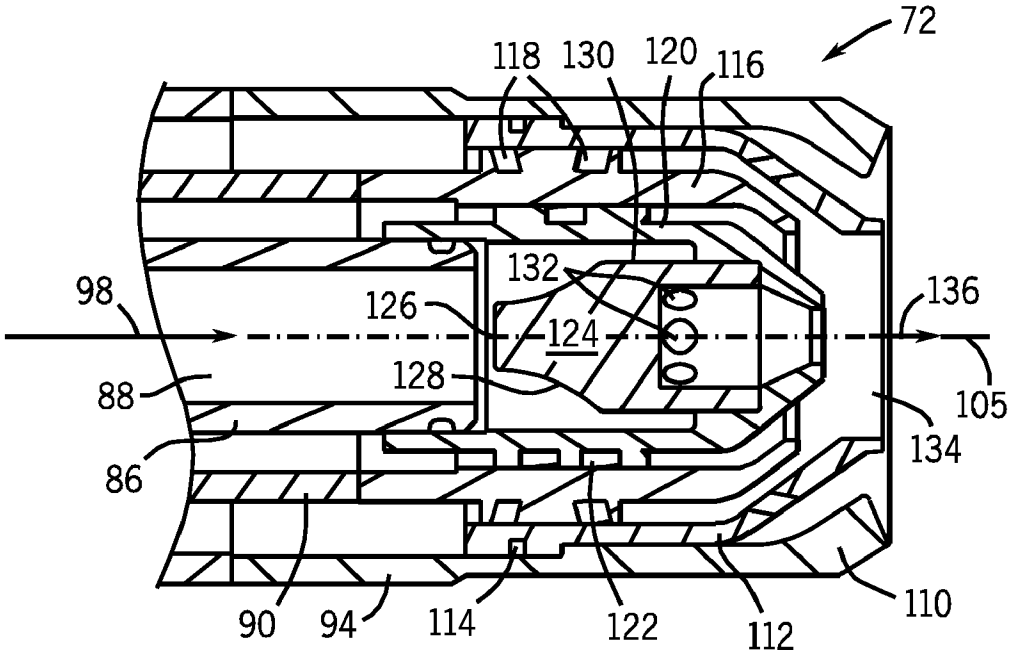
FIG. 7 is a detailed sectional side view of the tip of the liquid cartridge, as shown in FIG. 4, including an air atomizing tip, water tip, and fuel insert, in accordance with certain embodiments of the present technique.

FIG. 7 is a detailed sectional side view of the tip portion 72, including improvements in the design and materials to enhance durability and performance. The tip portion 72 includes an atomizing air tip 110, which is the exterior of the tip portion 72. A shroud 112 is located inside of, and concentric to, the atomizing air tip 110. Further, the shroud 112 is fixedly secured to the atomizing air tip 110 via joint 114. The joint 114 may couple the two components via any appropriate mechanism sufficient to block fluid flow and withstand the heat, wear, and tear that the tip portion 72 is subjected to. For example, the joint 114 may include a braze joint directly between the shroud 112 and the atomizing air tip 110. The brazed joint 114 may provide a seal to prevent by pass flow between the air tip 110 and shroud 112. Further, the joint 114 may withstand wear, improving system durability and performance. The tip portion 72 may also include a water tip 116 located coaxially inside the shroud 112. The water tip 116 may include swozzle holes 118 configured to produce a swirling motion as the air passes through the holes 118, thereby enhancing a mixing of the air with the fuel. The atomizing air tip 110 and water tip 116 may be secured by a weld or other durable coupling technique to the air tube 94 and water tube 90, respectively.

In addition, a fuel tip 120 may be located coaxially inside the water tip 116, wherein the fuel tip 120 is configured to enable fluid flow and mixing of the liquid fuel flowing in the downstream direction 98 through the fuel tip 120. The fuel tip 120 may also include swozzle holes 122 configured to swirl the water as it flows in the downstream direction 98 into the combustor. The fuel tip 120 includes a cavity for placement of a fuel insert 124 which may be configured to direct the liquid fuel flow toward the combustor and enhance the mixing of the fuel with the air and/or water as it flows out of the tip portion 72. The tip insert 124, includes a smooth, flat face surface 126 (e.g., perpendicular to central axis 105), which is connected to a radially expanding tapered portion 128. As depicted, the flat face surface 126 and radially expanding tapered portion 128 are configured to enable an increase in smooth laminar flow of the liquid fuel in the downstream direction 98 as it passes through the liquid cartridge 70. The tapered portion 128 may have a curved or cone shaped surface that results in a more uniform flow around and through the fuel insert 124. The tapered portion 128 expands radially from the upstream end portion near the face surface 126 to a downstream cylindrical portion 130.

The fuel insert 124 includes a cylindrical portion 130 that has holes or ports 132 to enable fuel flow and swirling within the fuel insert 124 as the fuel travels toward an exit region 134 of the tip portion 72. The geometry of the fuel insert 124 may improve atomization and create a swirling in the fuel flow to improve mixing and combustion. As depicted, the fuel ports 132 are tangentially angled with respect to the axis 105 through the center of the fuel tip 72, thereby enabling a swirling of the fuel as it flows through the ports 132. Further, the fuel ports may also be slightly angled in the direction 98 to enable flow toward the exit region 134. Moreover, the atomizing air tip 110, shroud 112, water tip 116, fuel tip 120, and fuel insert 124 may be composed of a durable material, such as a Cobalt based alloy, to withstand the heat and wear that the tip portion is subjected to. In the embodiment, the liquid fuel, air, and water may be mixed in the exit region 134 as the flows of all three fluids may be swirled upon exiting the tip portion 72. In addition, the swirling and mixing fuel, air, and water flow in a direction 136 into the combustor chamber for combustion to drive the turbine engine.

Technical effects of the invention include improved durability of fuel tip portion 72 components due to the improved design, configuration, materials, and coupling mechanisms of the disclosed embodiments. Further, the design and location of standoffs 100 and 102 within central body 74 may improve fluid flow performance and component durability while reducing complexity of the liquid cartridge 70 assembly. In addition, the configuration and design of the flange 76 may reduce manufacturing complexity while improving system durability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a liquid cartridge configured to mount in a fuel nozzle of a turbine engine, wherein the liquid cartridge comprises:

an atomizing air tip;

a water tip disposed coaxially within the atomizing air tip;

a fuel tip disposed coaxially within the water tip;

a shroud disposed coaxially between the atomizing air tip and the water tip, wherein the shroud is fixedly secured to the atomizing air tip; and a fuel insert disposed coaxially within the fuel tip, wherein the fuel insert comprises an upstream end portion that radially expands in a downstream axial direction of flow through the liquid cartridge.

2. The system of claim 1, wherein the atomizing air tip, the water tip, the fuel tip, the shroud, and the fuel insert comprise a Cobalt-based alloy.

3. The system of claim 1, wherein the shroud is brazed directly to the atomizing air tip.

4. The system of claim 1, wherein the fuel insert comprises a substantially flat upstream end portion coupled to a hollow cylindrical downstream portion by a tapered portion.

5. The system of claim 1, wherein the liquid cartridge comprises a one piece mounting flange having a water inlet, an air inlet, and a fuel inlet.

6. The system of claim 1, wherein the liquid cartridge comprises one or more standoffs radially separating coaxial tubes of the liquid cartridge, wherein the standoffs are symmetrical about a central axis of the liquid cartridge.

7. The system of claim 6, wherein each of the standoffs defines a plurality of equally sized and symmetrically spaced channels of flow between the coaxial tubes.

8. The system of claim 1, comprising a combustor having the fuel nozzle with the liquid cartridge.

9. The system of claim 8, comprising a turbine engine having the combustor.

10. A system, comprising:

a liquid cartridge configured to mount in a fuel nozzle of a turbine engine, wherein the liquid cartridge comprises:

an atomizing air tip;

a water tip disposed coaxially within the atomizing air tip;

a fuel tip disposed coaxially within the water tip;

a shroud disposed coaxially between the atomizing air tip and the water tip, wherein the shroud is fixedly secured to the atomizing air tip;

a fuel insert disposed coaxially within the fuel tip, wherein the fuel insert comprises an upstream end portion that radially expands in a downstream axial direction of flow through the liquid cartridge; and a standoff radially separating coaxial tubes of the liquid cartridge, wherein the standoff defines a plurality of equal sized channels between the coaxial tubes, and the standoff is symmetrical about a central axis of the liquid cartridge.

11. The system of claim 10, wherein an orientation of the standoff is orientation independent with respect to the fuel tip.

12. The system of claim 10, wherein the standoff has a square shaped geometry that mates with a cylindrical geometry of at least one of the coaxial tubes.

13. The system of claim 10, wherein the standoff is disposed between first and second coaxial tubes, and another standoff is disposed between second and third coaxial tubes.

14. The system of claim 13, wherein the standoffs are disposed at the same axial position, the standoffs both define equal sized channels, and the standoffs are both symmetrical about the central axis.

15. The system of claim 13, wherein the first, second, and third coaxial tubes define fuel, water, and air passages, respectively.

16. The system of claim 13, wherein the standoff is not C-shaped.

17. The system of claim 10, wherein the standoff has one of a triangle, pentagon, or hexagon shaped geometry that mates with a cylindrical geometry of at least one of the coaxial tubes.

18. A system, comprising:

an end cover; and a liquid cartridge configured to mount in a fuel nozzle of a turbine engine, wherein the liquid cartridge comprises:

a one piece flange configured to couple to the end cover, wherein the one piece flange comprises a water inlet, an air inlet, and a fuel inlet;

an atomizing air tip;

a water tip disposed coaxially within the atomizing air tip;

a fuel tip disposed coaxially within the water tip;

a shroud disposed coaxially between the atomizing air tip and the water tip, wherein the shroud is fixedly secured to the atomizing air tip;

a fuel insert disposed coaxially within the fuel tip, wherein the fuel insert comprises an upstream end portion that radially expands in a downstream axial direction of flow through the liquid cartridge.

19. The system of claim 17, comprising a combustor or the turbine engine having the fuel nozzle with the liquid cartridge.

20. The system of claim 17, wherein the liquid cartridge comprises one or more standoffs radially separating coaxial tubes of the liquid cartridge, wherein the standoffs are symmetrical about a central axis of the liquid cartridge.

21. The system of claim 10, comprising a combustor or the turbine engine having the fuel nozzle with the liquid cartridge.

* * * * *